US007958902B2

(12) United States Patent
Ruddy

(10) Patent No.: US 7,958,902 B2
(45) Date of Patent: Jun. 14, 2011

(54) MOBILITY ASSISTANCE DEVICE

(75) Inventor: Kevin C. Ruddy, Petersburg, MI (US)

(73) Assignee: No Boundaries Rehab, LLC, Petersburg, MI (US)

( * ) Notice: Subject to any disclaimer, the term of this patent is extended or adjusted under 35 U.S.C. 154(b) by 141 days.

(21) Appl. No.: 12/101,269

(22) Filed: Apr. 11, 2008

(65) Prior Publication Data

US 2009/0255562 A1 Oct. 15, 2009

(51) Int. Cl.
*A45B 9/04* (2006.01)

(52) U.S. Cl. ..... 135/84; 135/77; 135/65

(58) Field of Classification Search ..... 135/65, 135/75, 76, 77, 82, 84, 86
See application file for complete search history.

(56) References Cited

U.S. PATENT DOCUMENTS 3,524,456 A * 8/1970 Dixon ..... 135/65
4,899,771 A * 2/1990 Wilkinson ..... 135/77
5,103,850 A 4/1992 Davis
5,188,138 A 2/1993 Yamasaki et al.
5,301,704 A 4/1994 Brown
5,392,801 A 2/1995 Hannoosh et al.
5,713,382 A 2/1998 Midcap
5,806,548 A 9/1998 Goldstein et al.
5,865,204 A 2/1999 Bracy

* cited by examiner

*Primary Examiner* — David Dunn
*Assistant Examiner* — Danielle Jackson
(74) *Attorney, Agent, or Firm* — Fraser Clemens Martin & Miller LLC; J. Douglas Miller

(57) ABSTRACT

A mobility assistance device is disclosed including a main shaft having a handle attached to one end thereof and a ground engaging member attached to an opposite end. The ground engaging member includes a support member and at least one generally arcuate-shaped foot depending therefrom adapted to contact a supporting surface that facilitates a maximization of a traction and a surface to surface contact between the arcuate-shaped foot and the supporting surface. The shaft and the handle are oriented in respect of the ground engaging member to facilitate a proper posture and a gait of a user, thereby maximizing a stability of the user.

19 Claims, 4 Drawing Sheets

MOBILITY ASSISTANCE DEVICE

FIELD OF THE INVENTION

The present invention relates to a mobility assistance device, and more particularly to a mobility assistance device having an arcuate-shaped foot portion and a handle portion attached thereto adapted to maximize a stability of a user.

BACKGROUND OF THE INVENTION

Mobility or walking assistance devices such as canes and crutches, for example, have frequently been employed to offer stability to those who require mobility assistance. Conventional walking assistance devices comprise a main body portion which is typically a bar or pole formed from wood or metal. The devices are typically cut to a desired length. The devices also include a handle portion disposed at an upper part of the main body, and a foot portion disposed at a lower part of the main body. Typically, the foot portion includes a rubber cap having a flat surface for contacting the ground.

The conventional mobility assistance devices typically have a single foot. A problem encountered by users when using conventional mobility assistance devices is that when the device is extended by the user at angles forwardly or rearwardly, the foot does not provide adequate traction due to minimal surface to surface contact with the ground. Inadequate traction and minimal surface to surface contact between the foot and the ground surface can result in slippage and an undesirable reduction in a stability of the user. Another problem associated with conventional mobility assistance devices is that the single foot provides minimal lateral stability assistance, which leaves the user susceptible to toppling to the sides.

Prior art solutions provide limited resolution to the traction and the lateral stability of the conventional mobility assistance devices that have a single foot. One such solution is disclosed in U.S. Pat. No. 5,301,704. The '704 patent discloses a foot for a walking cane having an narrow elongate arcuate-shaped foot portion. The foot taught by the '704 patent provides increased traction and surface to surface contact when the cane is extended at angles forwardly or rearwardly, and therefore facilitates an increase in the stability of the user. However, the narrow elongate arcuate-shaped foot taught by the '704 patent does not provide stability in a lateral direction.

Another prior art solution is a device including a plurality of feet, typically four, for increasing stability of the user. An example of a mobility assistance device having four feet is disclosed in U.S. Pat. No. 5,806,548. The feet of these devices are typically arranged in a rectangular pattern to provide lateral stability and reduce the susceptibility of the user toppling to the sides. These types of devices, while providing an improvement in lateral stability, provide a minimal surface to surface contact between the ground and the feet thereof when the cane is extended at angles forwardly or rearwardly of the user.

Additionally, the typical mobility assistance devices having a plurality of feet cause a handle thereof to be in a fixed and an awkward position in respect of the user. The position of the handle causes the user to modify his or her posture from a natural, and preferred, position to properly use the cane. The modified posture typically causes the user to modify his or her gait, which can reduce the stability and increase the fatigue of the user of the device. Consequently, the user must either use the device improperly or modify his or her posture, both of which minimize the desired stability benefit of the mobility assistance device.

It would be desirable to produce a mobility assistance device that facilitates a maximization of a traction between a foot of the device and a ground, and provides a lateral stability to a user, while facilitating a proper posture of the user.

SUMMARY OF THE INVENTION

Compatible and attuned with the present invention, a mobility assistance device that facilitates a maximization of a traction between a feet of the device and a ground, and provides a lateral stability to a user, while facilitating a proper posture of the user, has surprisingly been discovered.

In one embodiment, a ground engaging member for a mobility assistance device comprises a support member adapted to be attached to a shaft of a mobility assistance device; and a plurality of generally arcuate feet depending from the support member adapted to contact a supporting surface.

In another embodiment, a mobility assistance device comprises a main shaft having a first end and a second end; a handle attached to the first end of the main shaft; and a ground engaging member attached to the second end of the main shaft, the ground engaging member having a support member and a plurality of generally arcuate feet depending from the support member and adapted to contact a supporting surface.

In another embodiment, a mobility assistance device comprises a main shaft having a first end and a second end, the main shaft formed from a pair of elongate members telescopically engaged and including a locking mechanism to secure the elongate members at a selected combined length; a handle attached to the first end of the main shaft, the handle having a generally L-shape including a leg member attached to the first end of the main shaft and a grip portion extending from the leg member; and a ground engaging member attached to the second end of the main shaft, the ground engaging member having a support member including a plurality of legs depending therefrom, each of the legs joined to a generally arcuate foot adapted to contact a supporting surface, wherein the main shaft is attached to the ground engaging member at a position laterally offset from a centerline of the ground engaging member toward one side of the mobility assistance device, and the main shaft is disposed at an angle in respect of vertical to cause the shaft to lean toward the one side of the mobility assistance device.

BRIEF DESCRIPTION OF THE DRAWINGS

The above, as well as other advantages of the invention, will become readily apparent to those skilled in the art from reading the following detailed description of a preferred embodiment of the invention when considered in the light of the accompanying drawings in which.

DETAILED DESCRIPTION OF THE PREFERRED EMBODIMENT

Figure 1:
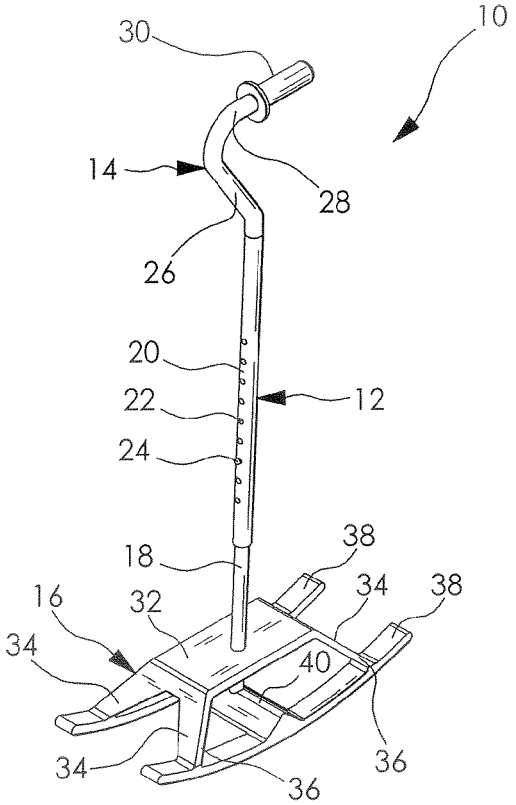
FIG. 1 is a perspective view of a mobility assistance device in accordance with an embodiment of the invention.
Figure 2:
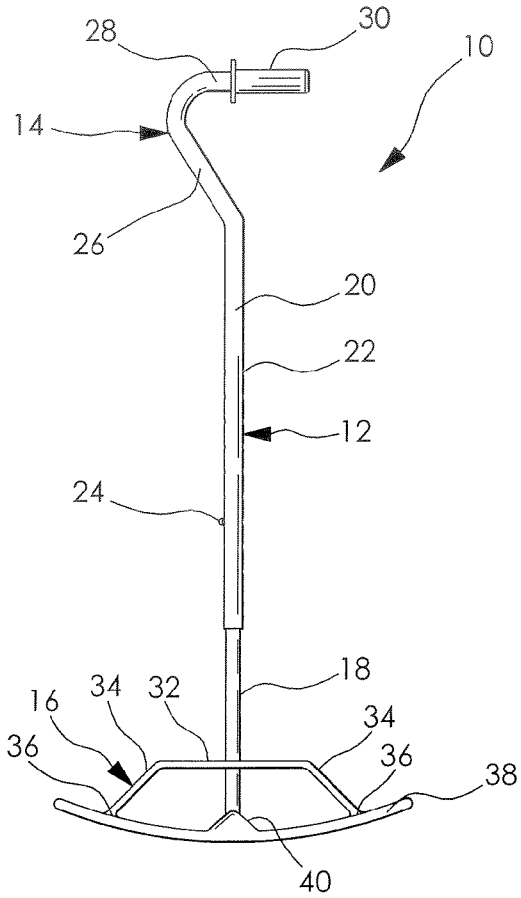
FIG. 2 is a side elevational view of the mobility assistance device illustrated in FIG. 1.
Figure 3:
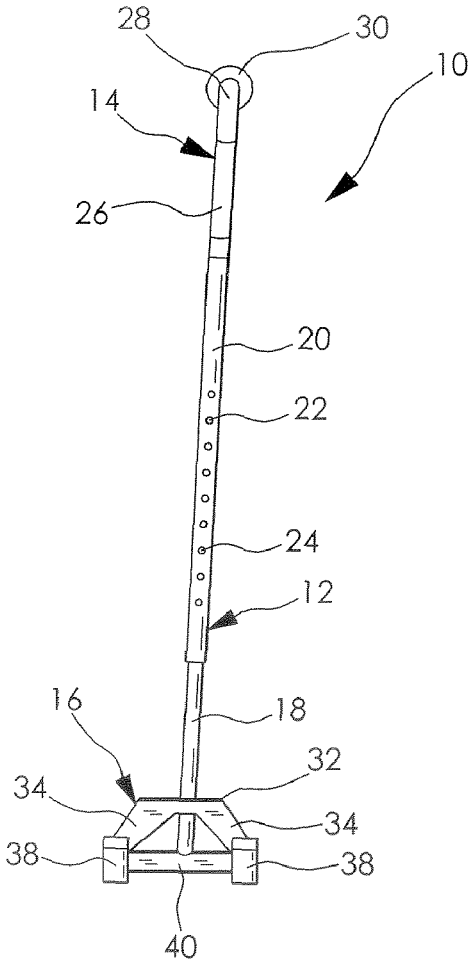
FIG. 3 is a front elevational view of the mobility assistance device illustrated in FIG. 1.

The following detailed description and appended drawings describe and illustrate various exemplary embodiments of the invention. The description and drawings serve to enable one skilled in the art to make and use the invention, and are not intended to limit the scope of the invention in any manner.

FIGS. 1-7 illustrate a mobility assistance device 10 in accordance with an embodiment of the invention. The mobility assistance device 10 includes a main shaft 12 having a handle 14 disposed at one end and a foot member or a ground engaging member 16 disposed at an opposite end thereof.

The main shaft 12 includes a pair of cooperating elongate members 18, 20 such as tubes for example. One end of member 18 is fixedly attached to the base member 18, and an opposite end thereof is adjustably connected to one end of the elongate member 20. It should be understood that the one end of elongate member 18 can be removably attached to foot member 16. In the embodiment shown, the elongate member 18 is slidably received within the elongate member 20 forming a telescoping connection therebetween to facilitate adjusting the length of the main shaft 12. It should be understood that other means may be employed to adjustably connect the elongate members 18, 20. Additionally, it should be understood that the shaft 12 can be formed from a single elongate member or more than two elongate members as desired. Further, in the illustrated embodiment the main shaft 12 is substantially straight and does not contain bends formed therein. However, it should be understood that the main shaft 12 can have other shapes such as including angled portions or bends therein, for example.

The elongate member 20 includes a plurality of apertures 22 formed therein, aligned in a longitudinal direction thereof. The apertures 22 are adapted to selectively receive a retractable protuberance 24 formed on the elongate member 18 to secure the elongate members 18, 20 in a selected position to provide a desired length to the main shaft 12. A device having this type of protuberance/aperture engagement is disclosed in U.S. Pat. No. 5,301,704, hereby incorporated herein by reference in its entirety. It should be understood that the elongate member 18 can be made to slidably receive elongate member 20 therein, wherein the apertures 22 are formed in the elongate member 20 and the retractable protuberance 24 is formed on the elongate member 18. Additionally, it should be understood that the apertures 22 can be formed in the elongate member 18 and a retractable pin (not shown) can be disposed on the elongate member 20, wherein the retractable pin can be selectively received by the apertures 22 formed in the elongate member 18 to secure the elongate members 18, 20 in a selected position to provide a desired length to the main shaft 12. Other Length adjustment structures can be used as desired. Preferably, the elongate members 18, 20 are formed from a lightweight material, such as aluminum, for example. However, other materials can be used to form the elongate members 18, 20 as desired.

The handle 14 is attached to an upper end of the elongate member 18 of the main shaft 12. The handle 14 has a generally inverted L-shape with a leg portion 26 and a grip portion 28. It should be understood that other shapes can be employed for the handle 14 such as a U-shape, for example. In the illustrated embodiment, the handle 14 is integrally formed with the elongate member 18. It should be understood that the handle can be removably and/or adjustably attached to upper end of the elongate member 18. The leg portion 26 is disposed at a forward leaning angle in respect of the main shaft 12 to position the grip portion 28 substantially above the longitudinal axis of the main shaft 12. It should be understood that the leg portion 26 can be disposed in longitudinal alignment with the main shaft 12 or at angles other than the illustrated angle. A grip 30 is disposed on the grip portion 28 to facilitate a user securely grasping the grip portion 28. The grip 30 is formed from a resilient material such as a foam rubber or an elastomeric material, for example. It should be understood that other materials can be employed to form the grip 30. In the embodiment shown, the handle 14 is formed from a lightweight material such as aluminum, for example. However, other materials can be used to form the handle 14 as desired.

The foot member 16 includes a substantially flat plate or support member 32 and a plurality of legs 34 depending therefrom. In the illustrated embodiment, four legs 34 are provided, one adjacent each of a corner of the plate 32. The legs 34 are integrally formed with the plate 32 and extend downwardly therefrom terminating at an end 36. It should be understood that the legs 34 can be formed as a separate component and attached to the plate 32 with a weld or a fastener, for example. Additionally, it should be understood that fewer or additional legs can be provided as desired.

The legs 34 terminate at a pair of spaced apart, arcuate-shaped, ground engaging feet 38. Favorable results have been obtained employing an arcuate-shape having a radius of thirteen inches. However, it should be understood that the arcuate-shape can have a different radius, a plurality of radii, and include linear portions. It should be understood that a single ground engaging arcuate-shaped foot can be provided, or more than two ground engaging, arcuate-shaped, feet can be provided. Favorable results have been obtained employing a pair of feet 38 spaced apart by about four and one half inches, wherein each of the feet 38 is about one inch wide and about ten and one half inches long. It should be understood that the feet 38 can be spaced apart at other distances and have other widths and lengths as desired. Additionally, it should be understood that employing a single foot may require a width thereof substantially equivalent to the distance between the outer edges of the pair of feet 38 to maximize a lateral stability of the mobility device 10. The ends 36 of the legs 34 are fixedly attached to an upper surface of the feet 38. In the illustrated embodiment, the ends 36 of the legs 34 are attached to the feet 38 with a weld. However, it should be understood that the legs 34 can be attached to the feet 38 employing other means such as a fastener, for example. A cross-member 40 is disposed on the upper surfaces of the feet 38 to maximize a structural rigidity of the foot member 16. In the illustrated embodiments, the foot member 16 is formed from aluminum. However, other materials can be used to form the foot member 16 as desired.

Figure 4:
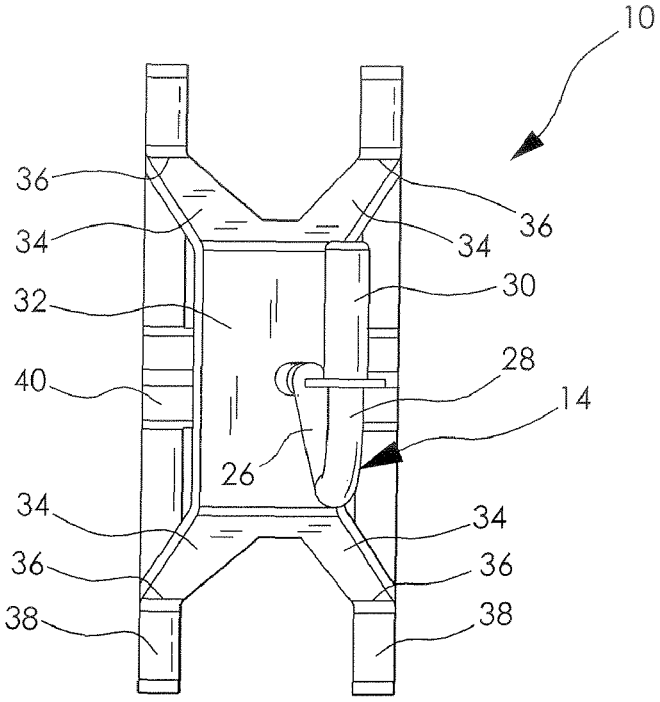
FIG. 4 is a top plan view of the mobility assistance device illustrated in FIG. 1.
Figure 5:
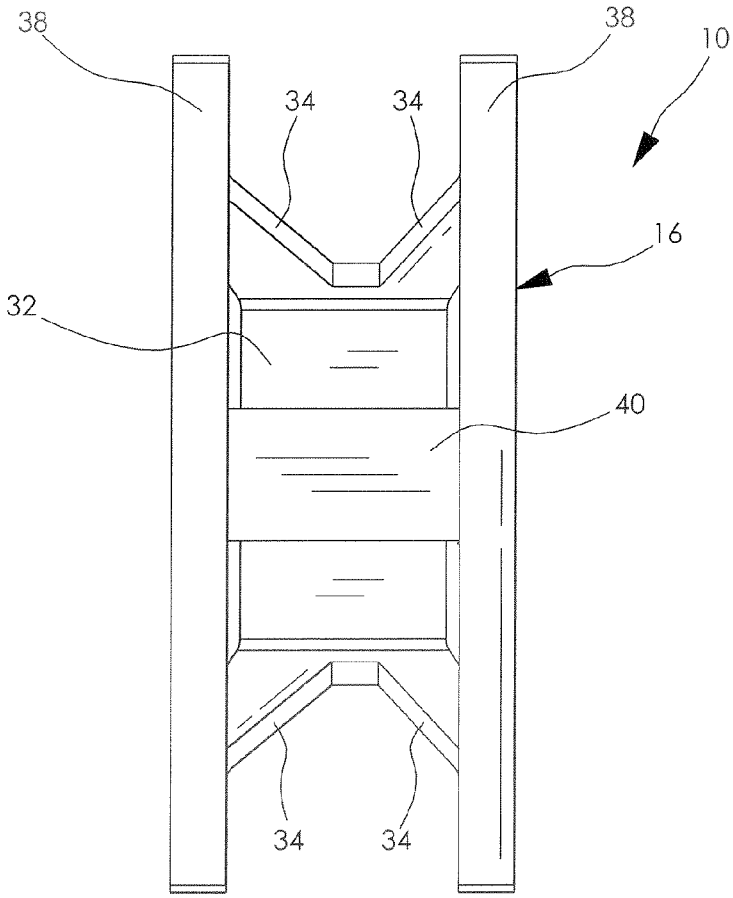
FIG. 5 is a bottom plan view of the mobility assistance device illustrated in FIG. 1.
Figure 6:
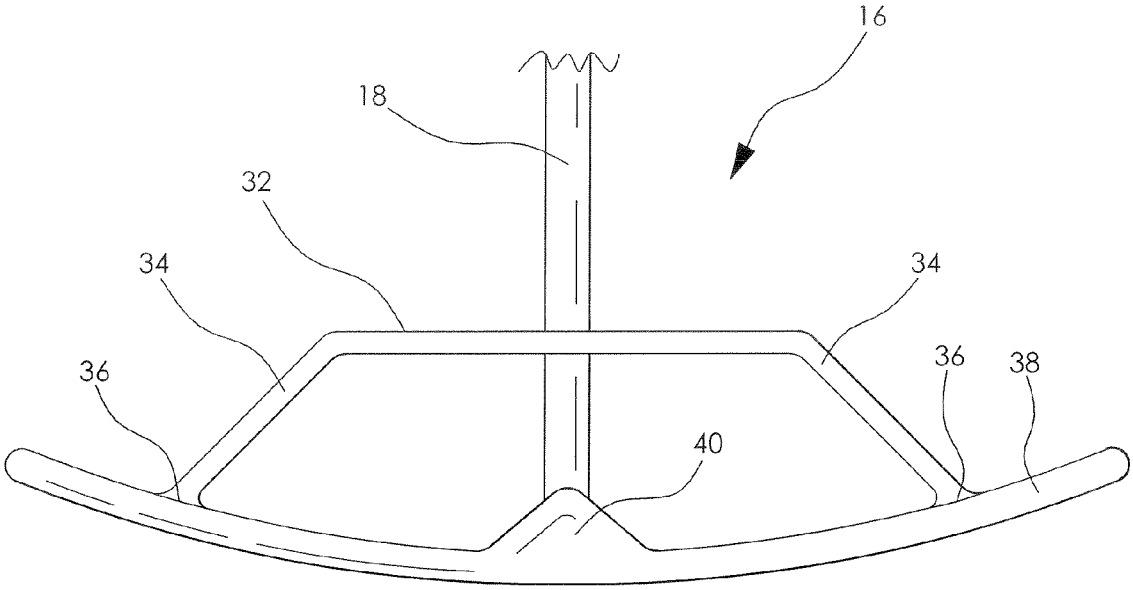
FIG. 6 is a enlarged fragmentary side elevational view of a foot member of the mobility assistance device illustrated in FIG. 1.

The main shaft 12 extends through the plate 32, having the lower end thereof attached to the cross member 40. The main shaft 12 is secured to both the plate 32 and the cross member 40 by a weld thereto, respectively. However, it should be understood that the main shaft 12 can be secured to the plate 32 and the cross member 40 employing other means such as a fastener, for example. The main shaft 12 is attached to the foot member 16 offset from a centerline running between and parallel to a longitudinal axis of the feet 38. The offset positions the main shaft 12 closer to one of the feet 38 or a side of the mobility assistance device 10 towards the user thereof. Additionally, the main shaft 12 is attached to the foot member 14 at an angle, as shown in FIG. 4. Thus, the main shaft 12 is leaning toward the side of the mobility assistance device 10 nearer the user thereof. Additionally, the main shaft 12 is not orthogonal to the support surface, but is disposed at an angle, thereby tilting the main shaft 12 toward the user. Favorable results have been obtained employing a five degree tilt angle for the main shaft 12 from vertical. The offset and angled position of the main shaft 12 cooperate to place the grip portion 28 of the handle 12 in a position facilitating an optimized posture and walking gait of the user. It should be understood that other shaft offsets and tilt angles can be employed as desired to accommodate a particular physical makeup or a physical requirement of the user.

The mobility assistance device 10 illustrated in FIGS. 1-7 is adapted to be employed for supporting a right hand side of the user. However, it should be understood that the elongate member 20 and handle 14 attached thereto can be rotated 180 degrees in respect of the elongate member 18 to facilitate use of the mobility assistance device 10 on a left hand side of the user.

Figure 7:
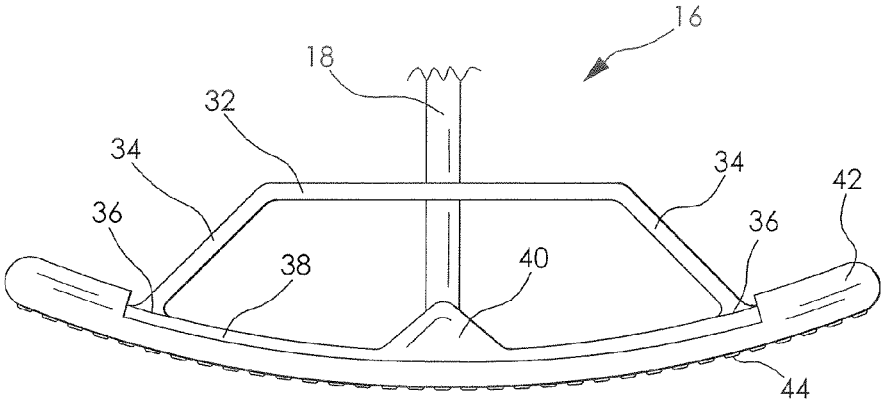
FIG. 7 is an enlarged fragmentary side elevational view of the foot member illustrated in FIG. 6 showing a gripping member attached thereto.

As illustrated in FIG. 7, the feet 38 can include a grip member 42 attached to a ground engaging lower surface thereof. The grip member 42 is formed from a rubber or an elastomeric material to facilitate maintaining a desired traction between the foot member 16 and the support surface, and cushion an impact between the feet 38 and the support surface. As shown, the grip member 42 includes a plurality of protuberances or an array of elements 44 extending outwardly from a bottom surface of the feet 38. The protuberances 44 are adapted to enhance the gripping and/or cushioning properties of the grip member 42. It should be understood that the bottom surface of the grip member 42 can be substantially smooth. Further, it should be understood that a linear or otherwise shaped foot can be formed to receive the grip member 42, wherein the grip member 42 is formed to provide the desired arcuate-shape to the ground engaging lower surface of the foot member 16.

Figure 8A:
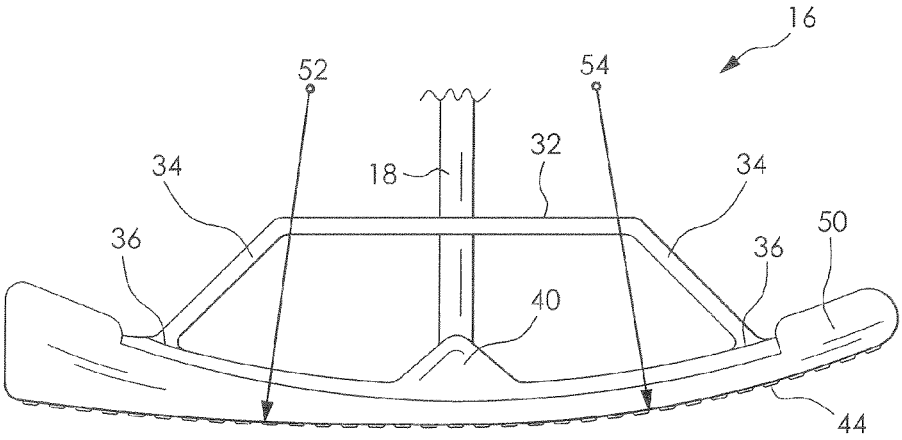
FIG. 8*a* is an enlarged fragmentary side elevational view of the mobility assistance device illustrated in FIG. 1 having a foot member in accordance with another embodiment of the invention.

The arcuate-shaped feet 38 illustrated in FIGS. 1-6 and the grip member 42 illustrated in FIG. 7 are generally defined by a single radius. However, the arcuate-shaped feet 38 and the grip member 42 can have a shape defined by more than one radius, and can include linear portions. An arcuate-shaped foot 50 according to another embodiment of the invention is illustrated in FIG. 8*a*. The generally arcuate-shaped foot 50 includes a first radius 52 at a leading end or toe of the foot 50 and a second radius 54 extending therefrom to form a trailing end or heel of the foot 50. In the embodiment shown, the first radius 52 is greater than the second radius 54. Favorable results have been obtained employing a radius of about twenty-six inches for the first radius 52 and about a thirteen inch radius for the second radius 54. A transition from the first radius 52 to the second radius 54 may occur substantially at a mid-point along the length of the feet 38. However, it should be understood that other dimensions can be used for the radii 52, 54, and the transition between the radii 52, 54 can be located at a other points along the length of the feet 38.

Figure 8B:
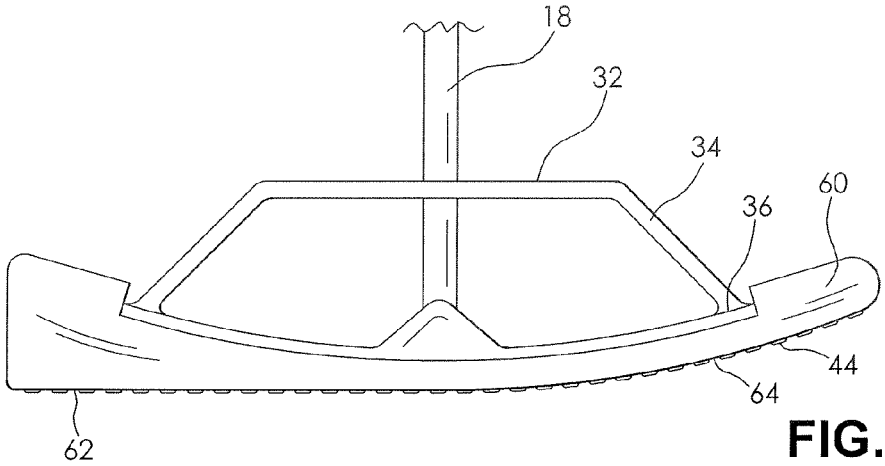
FIG. 8*b* is an enlarged fragmentary side elevational view of the mobility assistance device illustrated in FIG. 1 having a foot member in accordance with another embodiment of the invention.

A generally arcuate-shaped foot 60 according to another embodiment of the invention is illustrated in FIG. 8*b*. The foot 60 includes a linear portion 62 at a leading end or a toe of the foot 60 and an arcuate portion 64 extending from the linear portion 62 to form a trailing end or heel of the foot 60. Favorable results have been obtained employing about a thirteen inch radius to define the arcuate portion 64. A transition from the linear portion 62 to the arcuate portion 64 may occur substantially at a mid-point along the length of the feet 38. However, it should be understood that other dimensions can be used for the arcuate portion 64, and the transition between the linear portion 62 and the arcuate portion 64 can be located at other points along the length of the feet 38. Additionally, it should be understood that other composite shapes can be employed for the feet 38 that include arrangements and quantities of arcuate and linear portions different from the illustrated embodiments.

The mobility assistance device 10 having the composite shaped foot with a defined leading and trailing end is adapted to provide support to one of a left hand side or a right hand side of the user. With the leading end or toe of the feet 38 pointing away from the user, the main shaft 12 is offset to the left of the centerline between and parallel to the feet 38, and leans to the left side of the mobility assistance device 10 to facilitate supporting the right side of the user. Alternatively, when the main shaft 12 is offset toward and leans to the right side of the mobility assistance device 10, the mobility assistance device 10 facilitates supporting the left side of the user.

Alternatively, as described above, the grip members 42 can be attach to the feet 38 and provide the arcuate-shape or the composite shape for the ground engaging surfaces of the foot member 16. The grip members 42 can be adapted to be removable from the feet 38 and re-attached thereto in a reversed orientation in respect of the feet 38 to facilitate adapting the mobility assistance device 10 to support either the left side or the right side of the user.

It should be understood that the foot member 16 can be manufactured and sold as a separate component. In such a configuration, the foot member 16 is adapted to attach to a conventional mobility assistance device, such as a straight cane, for example. The foot member 16 can be attached to the conventional mobility assistance device in any manner, such as by a telescoping engagement or a threaded engagement, for example. Further, the means of attachment provided with the component foot member 16 can be adapted to position the conventional mobility assistance device in the offset and tilted configuration substantially similar to the mobility device 10.

Additionally, it should be understood that the main shaft 12 and the handle 14 can be manufactured and sold together or separately, wherein the main shaft 12 and/or the handle 14 are adapted to attach to a foot member of a conventional mobility assistance device. The main shaft 12 and/or the handle 14 being adapted to position the foot member of the conventional mobility assistance device in an offset position in respect of the handle 14, substantially similar to the mobility assistance device 10.

In use, the main shaft 12 is extended to a desired length by manipulating the engagement between the elongate member 18 and the elongate member 20. The handle portion 14 is oriented wherein the grip portion 28 points toward the user. The user grasps the grip 30 with a hand to securely hold the mobility assistance device 10. The user can exert a force on the handle 14 to support at least a portion of the user's weight, which is transferred through the main shaft 12 and the foot member 16 to the support surface, such as a floor or the ground.

The main shaft 12, being offset and tilted toward the user, positions the foot member 16 in a position that is laterally spaced further from the side of the user than the grip portion 28 of the handle 14. Thus, an interference between the foot member 16 and a normal movement of the leg and the foot of the user adjacent the mobility assistance device 10 is minimized. Additionally, the offset and tilt of the main shaft in respect of the foot member 16 allows a substantially direct vertical alignment between a shoulder of the user and the handle 14, to facilitate an ergonomic use of the mobility assistance device 10.

As the user moves forward or backward, the feet 38 pivot on the ground in a rocking motion to maximize a contact surface between the feet 38 and the ground throughout the entire forward or backward step. Since the foot member 16 includes at least a pair of spaced apart feet 38, or a single foot having a width substantially equivalent to the distance between the outer edges of the spaced apart feet 38, the stability of the mobility assistance device 10 is maximized in a side to side direction as well as in a front to back direction. Additionally, for the embodiment where the feet 38 include the grip member 42, a traction and an impact absorbing characteristic of the mobility assistance device 10 are maximized. Additionally, the grip member 42 can be replaced if it becomes damaged or worn, to maintain a desired level of the traction and the impact absorbing characteristics of the mobility assistance device 10.

The mobility assistance device 10 described herein provides a maximization of a traction between the foot member 16 and the ground, and provides a lateral stability to a user. Additionally, the unique structure of the main shaft 12, handle 14, and foot member 16 create an ergonomic mobility assistance device 10 that facilitates a proper posture of the user, which further enhances the stability of the user and minimizes a fatigue of the user.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A ground engaging member for a mobility assistance device comprising:

a support member adapted to be attached to a shaft of a mobility assistance device; and a pair of elongate, spaced apart, substantially parallel, and generally arcuate feet depending from the support member adapted to contact a supporting surface, and further including a cross member connecting the spaced apart generally arcuate feet, wherein the cross member is spaced apart from the support member.

2. The ground engaging member according to claim 1, wherein the support member is a substantially planar plate.

3. The ground engaging member according to claim 2 including a plurality of legs integrally formed with the plate and depending therefrom, the legs joined to the generally arcuate feet.

4. The ground engaging member according to claim 1, wherein the generally arcuate feet are defined by a single radius.

5. The ground engaging member according to claim 4, wherein the radius is about thirteen inches.

6. The ground engaging member according to claim 1, wherein the generally arcuate feet are defined by at least one radius and at least one linear portion.

7. The ground engaging member according to claim 1, wherein a grip member is disposed on the generally arcuate feet.

8. The ground engaging member according to claim 7, wherein the grip member is formed from an elastomeric material adapted to provide a desired traction between the ground engaging member and the supporting surface.

9. A ground engaging member for a mobility assistance device comprising:

a support member adapted to be attached to a shaft of a mobility assistance device; and a pair of spaced apart generally arcuate feet depending from the support member adapted to contact a supporting surface, wherein the generally arcuate feet are defined by two radii.

10. The ground engaging member according to claim 9, wherein one radius is about thirteen inches and the other radius is about twenty-six inches.

11. A mobility assistance device comprising:

a main shaft having a first end and a second end;

a handle attached to the first end of the main shaft; and a ground engaging member attached to the second end of the main shaft, the ground engaging member having a support member and a plurality of generally arcuate feet depending from the support member and adapted to contact a supporting surface, wherein the shaft is fixed at an angle in respect of vertical from the first end to the second end of the shaft to cause the shaft to lean along an entirety of the shaft toward a side of the mobility assistance device.

12. The mobility assistance device according to claim 11, the main shaft including a pair of elongate members telescopically engaged and including a locking mechanism to secure the elongate members at a selected combined length.

13. The mobility assistance device according to claim 11, wherein the main shaft is attached to the ground engaging member at a position laterally offset from a centerline of the ground engaging member toward one of the arcuate-shaped feet.

14. The mobility assistance device according to claim 11, wherein the angle is about five degrees.

15. The mobility assistance device according to claim 11, wherein the generally arcuate feet are defined by a single radius.

16. The mobility assistance device according to claim 11, wherein the generally arcuate feet are defined by at a least one radius and at a least one linear portion.

17. The ground engaging member according to claim 11, wherein a grip member is disposed on the generally arcuate feet to provide a desired traction between the generally arcuate feet and the supporting surface.

18. A mobility assistance device comprising:

a main shaft having a first end and a second end, the main shaft formed from a pair of elongate members telescopically engaged and including a locking mechanism to secure the elongate members at a selected combined length;

a handle attached to the first end of the main shaft, the handle having a generally L-shape including a leg member attached to the first end of the main shaft and a grip portion extending from the leg member; and a ground engaging member attached to the second end of the main shaft, the ground engaging member having a support member including a plurality of legs depending therefrom, each of the legs joined to one of a pair of elongate, spaced apart, substantially parallel, and generally arcuate feet adapted to contact a supporting surface, and further including a cross member connecting the spaced apart generally arcuate feet, wherein the main shaft is attached to the ground engaging member at a position laterally offset from a centerline of the ground engaging member toward one side of the mobility assistance device, and the main shaft is fixed at an angle of about five degrees in respect of vertical from the first end to the second end of the shaft to cause the shaft to lean along an entirety of the shaft toward the one side of the mobility assistance device.

19. A mobility assistance device comprising:

a main shaft having a first end and a second end;

a handle attached to the first end of the main shaft; and a ground engaging member attached to the second end of the main shaft, the ground engaging member having a support member and a plurality of generally arcuate feet depending from the support member and adapted to contact a supporting surface, wherein the shaft is at an angle in respect of vertical to cause the shaft to lean toward a side of the mobility assistance device, wherein the generally arcuate feet are defined by two radii.

* * * * *